US005768726A

United States Patent [19]

Myles

[11] Patent Number: 5,768,726

[45] Date of Patent: Jun. 23, 1998

[54] MATTRESS SPRING CORE ASSEMBLY COVER

[76] Inventor: Eddie Lee Myles, 3101 S. Fairview St., #58, Santa Ana, Calif. 92704

[21] Appl. No.: 681,839

[22] Filed: Jul. 29, 1996

[51] Int. Cl.[6] ..... A47C 27/045

[52] U.S. Cl. ..... 5/737; 5/716; 5/721; 5/738

[58] Field of Search ..... 5/716, 717, 719, 5/721, 737, 738

[56] References Cited

U.S. PATENT DOCUMENTS

| | | | |
|---|---|---|---|
| D. 280,169 | 8/1985 | Henry . | |
| 1,882,538 | 10/1932 | Wunderlich | 5/738 |
| 2,399,628 | 5/1946 | Cunningham | 5/716 |
| 3,055,021 | 9/1962 | Rymland | 5/716 |
| 3,256,535 | 6/1966 | Anson | 5/716 |
| 4,445,241 | 5/1984 | Ender et al. . | |
| 4,658,454 | 4/1987 | Potter . | |
| 4,809,375 | 3/1989 | Bull | 5/738 |
| 5,285,542 | 2/1994 | West et al. . | |
| 5,432,964 | 7/1995 | Strell . | |
| 5,435,026 | 7/1995 | Cavazos . | |

*Primary Examiner*—Flemming Saether
*Assistant Examiner*—Robert G. Santos
*Attorney, Agent, or Firm*—Frank J. Uxa

[57] ABSTRACT

Apparatus and method for placing a cover or coat on a mattress spring core assembly. The cover has a first cover portion and a second cover portion. Each cover portion is generally padded and has an attached annular skirt for covering the sides of the spring core assembly. The cover portions are fitted with fasteners having hook shaped ends which extend away from the attached cover and protrude inwardly for attaching the top and bottom cover portions to the top and bottom portions of the spring core assembly. After the first and second cover portions are attached to the spring core assembly, the annular skirts are connected together to completely enclose the spring core assembly.

20 Claims, 3 Drawing Sheets

MATTRESS SPRING CORE ASSEMBLY COVER

FIELD OF THE INVENTION

This invention relates to covers and more particularly, to an apparatus and method for covering mattress spring core assemblies.

BACKGROUND OF THE INVENTION

When a conventional mattress spring core assembly cover, or mattress cover, becomes worn, damaged or badly soiled, it is typically discarded and replaced with a new one. This generally means replacing the mattress cover as well as the mattress spring core assembly or innerspring as a one piece unit. However, new beds are expensive and difficult to move. Further, the discarded beds are generally sent to already overburdened landfills and may even become a fire hazard.

Often times, conventional beds are replaced before the spring core assembly is worn out. For example, many spring core assemblies are designed with infinite life or long life springs. These springs will typically last much longer than the originally equipped mattress cover. Thus, if a bed becomes worn, damaged or badly soiled, it is often just the mattress cover and not the spring core assembly that needs replacement. Thus, there is a need for a mattress cover which can replace an original mattress cover as it becomes worn, damaged or soiled and does not require the replacement of the spring core assembly.

Conventional beds are also commonly replaced before the spring core assembly is worn because the user is no longer comfortable with the level or type of padding provided by the existing mattress cover. In these instances, a user may desire additional padding, or even a different type of padding. Currently, this would require the purchase of an entirely new bed, including a new spring core assembly. Thus, there is a need for a cover that can provide varying amounts and types of padding to fit the needs of different users which does not require the need to replace the spring core assembly.

Recently, mattress covers have been developed that fit over the originally equipped mattress cover. These mattress covers attach to the original mattress cover using various methods and provide additional padding. However, as mentioned, these mattress covers are fitted over the existing bed mattress cover which can reduce the comfort and cleanliness of the new cover. This is particularly true if the existing mattress is worn, damaged, or soiled. Thus, there is a need for a cover that can replace existing mattress covers or, in the alternative, also be used to fit over an existing mattress cover.

An additional problem with conventional beds is their high cost. Often times a user will extend the life of a mattress cover well beyond a generally comfortable or sanitary life to avoid the high cost of replacing the bed. This is also true for users who are only staying at a location temporarily and do not want to have to pay the high cost for a new bed. Thus, there is a need for a mattress spring core assembly cover, that is much less expensive than a new bed.

For the foregoing reasons, there is a need for a mattress spring core assembly cover that can easily and inexpensively replace an original or previous spring core assembly mattress cover.

SUMMARY OF INVENTION

The present invention satisfies the need for a cover that can be installed over the mattress spring core assembly of a conventional bed when the originally equipped mattress cover becomes worn, damaged, soiled or is no longer desirable. The cover of the present invention can be used to replace the existing mattress cover or, alternatively, can be fitted over the existing mattress cover to provide a different level of padding and insulation.

By eliminating the need to unnecessarily discard the spring core assembly every time a mattress cover becomes worn, soiled, or damaged, a generally like-new bed can be created with a much lower cost than a newly purchased bed. Additionally, since the spring core assembly is reused, the amount of waste is reduced. Thus, the cover of the present invention provides a mattress cover that creates a like-new bed for a fraction of the cost, is simple to install, and allows for different levels of padding and insulations.

The present invention is generally directed to a cover for a conventional bed which has an internal spring core assembly having a top portion, sides, and an opposing bottom portion. In one broad aspect, a cover is provided which comprises a first cover portion and a generally opposing second cover portion. The first cover portion has a first panel with an attached annular skirt. The annular skirt extends around the first panel. The second cover portion has a second panel.

A plurality of strips, each of which has a first end and a second end are attached at their first end irrespectively, to the first and second cover portions. The second end generally extends away from the irrespective first and second panels.

A plurality of fasteners, each of which has a proximal end and a distal end are attached at their proximal end to the second end of each of the strips. The distal ends of the fasteners are configured such that they may be attached to the sides of the spring core assembly so that the first and second cover portions surround the respective top and bottom portions and generally enclose the spring core assembly.

In another broad aspect of the present invention, a cover for a spring core assembly is provided which has a first panel and a generally opposing second panel. The first and second panel are generally spaced apart. An annular skirt generally extends around and attaches the first panel to the second panel. The annular skirt has a slit which is located between and extends parallel to the first and second panels. The slit may extend around the annular skirt such that said first and second panels may be folded at least partially open.

Methods for placing a cover on a conventional spring core assembly which has a top portion, sides and an opposing bottom portion, for example the presently described apparatus, are included within the scope of the present invention. In general, such methods comprise placing a first cover portion which has an attached annular skirt and a plurality of fasteners on the top portion of the mattress spring core assembly. The annular skirt is wrapped around the spring core assembly and covers at least a portion of the sides. The first cover portion is then attached to the spring core assembly using the plurality of fasteners which are connected to the first cover portion. A second cover portion which has a second annular skirt and a plurality of fasteners is then placed on the bottom portion and the second annular skirt is wrapped around and covers at least a portion of the sides. The second cover portion is then attached to the spring core assembly using the plurality of fasteners connected to the second cover portion.

The invention, together with additional features and advantages thereof, may be best understood by reference to the following description taken in conjunction with the accompanying illustrative drawings.

DETAILED DESCRIPTION

Figure 1:
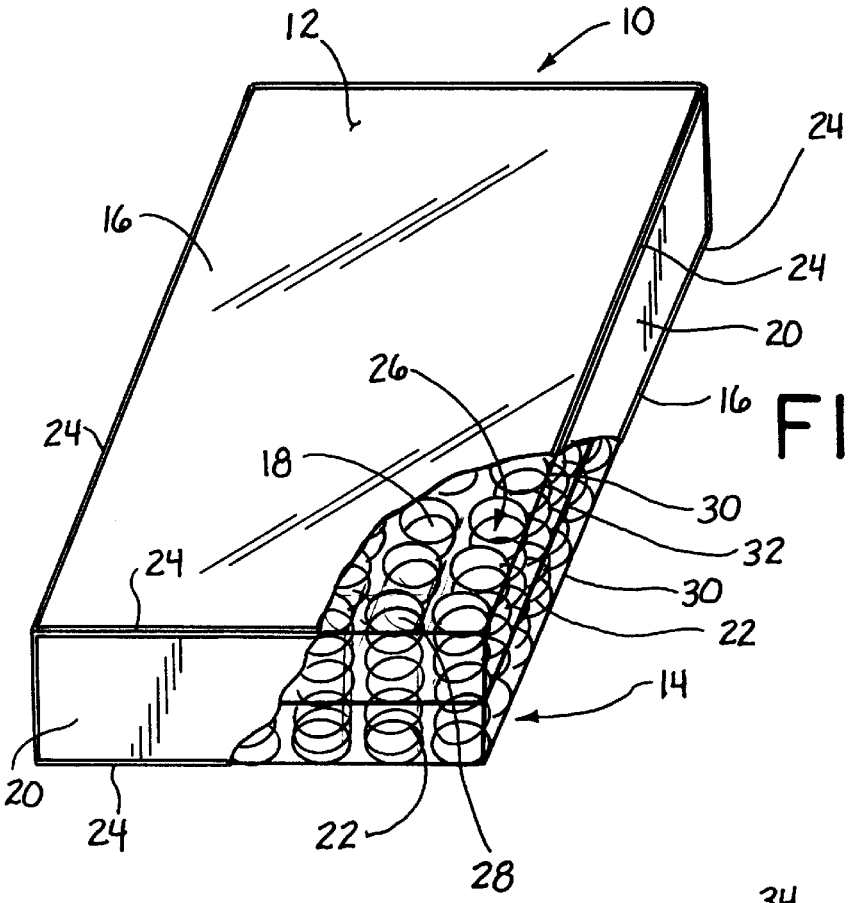
FIG. 1 is a perspective view of a typical conventional bed showing the originally equipped mattress cover and broken away to expose the mattress spring core assembly.
Figure 2:
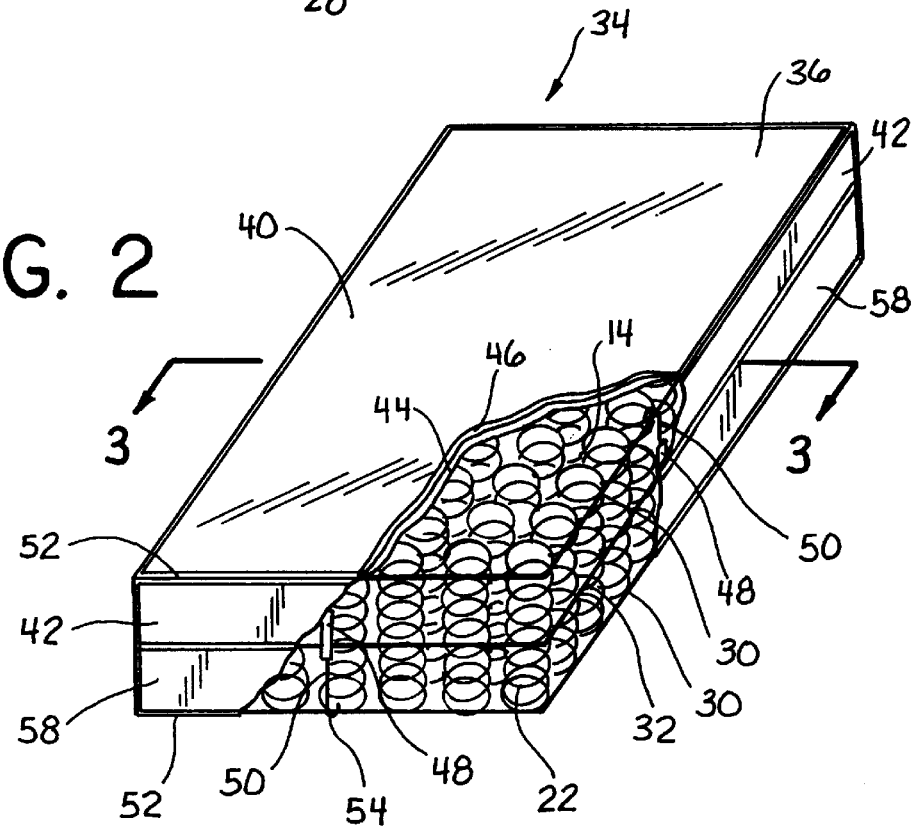
FIG. 2 is a perspective view of an embodiment of the present invention with the cover installed over a conventional mattress spring core assembly and partially broken away to expose the spring core assembly.

Referring now to FIG. 1, a typical conventional bed or mattress 10 is shown with an original mattress cover 12 and a typical mattress spring core assembly 14. Top and bottom cover panels 16 fit on the broad top and bottom portions 18 of the mattress spring core assembly 14. These panels 16 typically comprise padding and an insulator (not shown). Vertical side panels 20 cover the vertical sides 22 of the spring core assembly 14 and hold top and bottom panels 16 in place. Binding tape 24 is used to finish the seam connecting the vertical side panels 20 to the top and bottom panels 16.

The conventional mattress spring core assembly 14 is generally an assembly of coils springs forming a core as is well known in the art. The conventional spring core assembly 14, as exposed in FIG. 1, typically has an innerspring core 26, including peripheral coils 28 and top and bottom border wires 30. Some spring core assemblies 14, may also come fitted with an intermediate border wire 32.

Referring now to FIGS. 2–5, a cover 34 according to the present invention having a first cover portion 36 and a second cover portion 38 is shown fitted over a conventional spring core assembly 14. The first cover portion 36 has a generally flat panel 40 and an attached annular skirt 42. The flat panel 40 may be fitted with an insulator 44 and padding 46. The insulator 44 is generally styled to be essentially similar to the originally equipped insulator and may be made from wire or synthetic mesh, natural or synthetic fibers, or any insulator material, as is well known in the art. The padding 46 is preferably equipped to be essentially similar to padding generally supplied in the art and may be made from fibers, foam or any type of padding which is well known in the art. The insulator 44 and padding 46 may be configured to give the other wise flat panel 40 an uneven surface.

The insulator 44 and padding 46 may be omitted in certain applications of the present invention. This would particularly be the case if the cover 34 was used over a bed 10 without first removing the originally supplied mattress cover 12. The cover 34 of the instant invention may be supplied with different quantities and qualities of insulators 44 and padding 46 to allow for varying comfort levels and costs. The padding 46 may also be configured into any desired pattern or number of layers without varying from the scope or intent of the present invention.

The attached annular skirt 42 extends from the flat panel 40 down the sides 22 of the spring core assembly 14. In a preferred embodiment, the annular skirt 42 extends halfway down the sides 22, but may extend more or less as will be described later. The annular skirt 42 is generally attached to the flat panel 40 by any means as is well known in the art. In a preferred embodiment, the annular skirt 42 is sewn to the flat panel 40 using binding tape 52 to finish the seam. The annular skirt 42 may also be formed from a panel that extends to cover two of the sides 22 with two additional side pieces attached (not shown). The annular skirt 42 as well as the flat panel 40 are preferably made from materials which are well known in the art. Such materials may include natural or synthetic fibers such as Damask or similar. The annular skirt 42 may or may not include padding.

A plurality of strips 48 are attached to the first cover portion 36. The strips 48 are generally narrow flat pieces which are made from a flexible material. The strips may also be of an elastic material. Any flexible material, such as natural or synthetic fibers, rubber, elastic, or the like, may be used. The strips 48 are attached at a first end to the junction of the flat panel 40 with the annular skirt 42. The attachment may be accomplished using the same methods described for attaching the annular skirt 42 with the panel 40. The strips 48 may also be attached to either the flat panel 40 or the annular skirt 42 individually. Attachment means may include sewing, bonding, inner fiber weaving, fastening, or similar.

The strips 48 are generally spaced around the peripheral edge of the flat panel 40 and extend perpendicularly away, along the inside of the annular skirt 42. The strips 48 may preferably be spaced every 6 to 12 inches with additional strips 48 placed at the corners. The spacing of the strips 48 around the peripheral edge of the flat panel 40 may vary depending on the size of the spring core assembly 14, the amount of padding 46 supplied with the cover portion 36, and the type of spring core assembly 14.

Fasteners 50 are fitted on the second ends of the strips 48 and also extend away from the panel 40. The fasteners have a proximal end (not shown) for attachment to the first end of the strips 48 and may be attached using any means, such as sewing, bonding, riveting, bolting alone or in combination, or the like. Alternatively, the fasteners 50 may be fitted with an enlarged or specially configured end (not shown) which can engage a loop or hole (not shown) in the strips 48 as a means of attachment.

The fasteners 50 are preferably configured to engage the top and bottom border wires 30 of the spring core assembly 14 but may be configured to engage the peripheral coils 28 as well. The fasteners 50 may also be configured to attach to intermediate border wire 32 or even to attach to an original mattress cover 12 that has not been removed from the spring core assembly 14.

Fasteners 50 are preferably hook-shaped members with a distal end 54 that may be hook-shaped. The hook-shaped distal end 54 is preferably large enough to fit over the largest diameter wire used in constructing the particular size spring core assembly 14 yet small enough to so as not to protrude or be felt under the cover portion 36. The fasteners 50 may be of any material suitable for securing the cover portion 36 to the spring core assembly 14 such as a metal wire, hard plastic, rubber, or similar. A metal wire with a plastic or rubber coating may also be used.

An alternative embodiment may include fasteners which can be bent after attachment to the spring core assembly 14 to ensure a permanent fit and to minimize any protrusions.

In this embodiment the fastener may be a metal wire or a plastic coated metal wire. The distal end 54 would be placed over the desired border wire or coil spring of the spring core assembly 14 and the distal end 54 may then be bent around the spring core assembly 14. Bending may be caused by hand or through the use of pliers or plier like tools.

The second cover portion 38 is configured to be placed on the opposite side of the spring core assembly 14 as the first cover portion 36. The second cover portion 38 has a second panel 56 and a second annular skirt 58. The second panel 56 is generally similar to the first panel 40 and is also fitted with padding 46 and an insulator 44 as described above. However, to provide for varying bed surface types and costs, the quantity and type of padding 46 and insulator 44 may be varied from that used on the first panel 40, or even eliminated altogether.

The attached second annular skirt 58 is generally similar to the annular skirt 42 described above in both manner of construction as well as materials. In a preferred embodiment, the second annular skirt 58 extends halfway down the sides 22, to meet up against the opposing annular skirt 42 in an abutting fashion. The second annular skirt 58 is generally attached to the second flat panel 56 using the same means described to attach the annular skirt 42 to the first flat panel 40.

Figure 3:
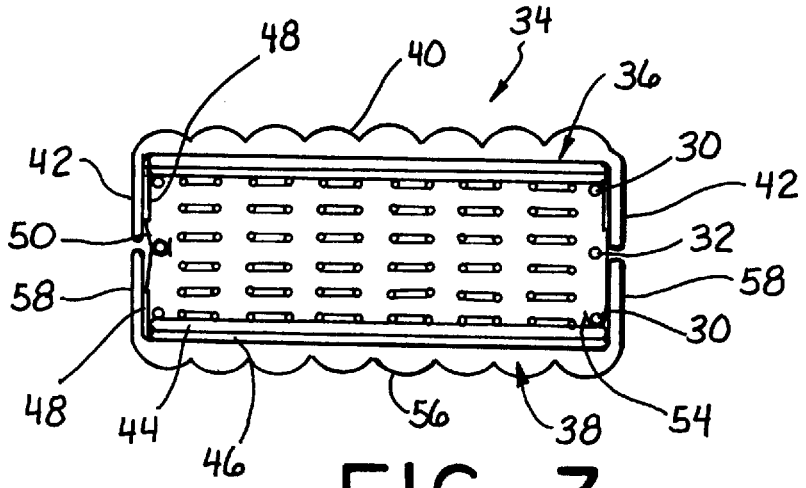
FIG. 3 is a sectional view, taken generally along line 3—3 of FIG. 2.

In one embodiment of the present invention, the first and second annular skirts 42 and 58 may meet in an abutting fashion somewhere other than midway along the sides 22 of the spring core assembly 14. In this embodiment, as shown in FIG. 3, the first annular skirt 42 extends a portion of the way along the sides 22 and the second annular skirt 58 extends the remaining distance to meet in an abutting fashion. The first and second annular skirts 42 and 58 may then be connected to each other using a zipper, bottom and loop assemblies, hook and loop material, Velcro, snaps, or the like.

Figure 4:
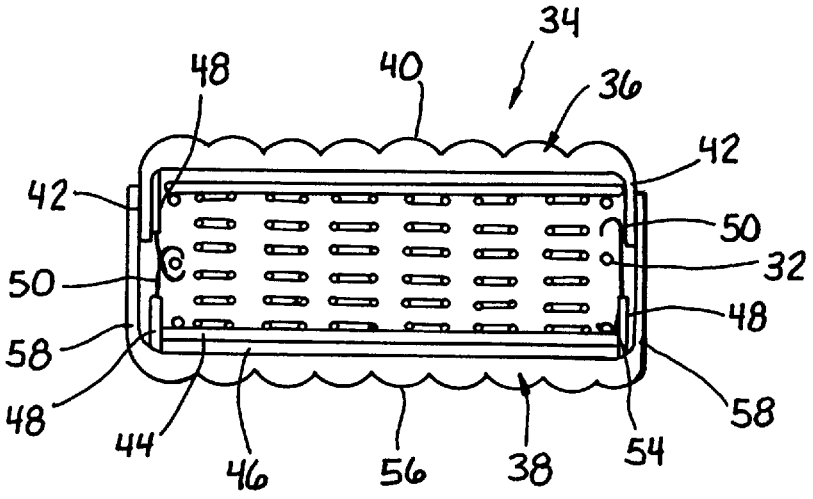
FIG. 4 is a sectional view of an embodiment of the present invention.

In another embodiment, as depicted in FIG. 4, the first annular skirt 42 extends a portion of the way down the sides 22 and the second annular skirt 58 extends a greater distance along the sides 22 such that the second annular skirt 58 overlaps the first annular skirt 42. In this fashion, the entire spring core assembly 14 is covered by the first and second cover portions 36 and 38. The first and second annular skirts 42 and 58 may be configured with button and loop assemblies, Velcro, snaps, and the like, to facilitate their connection. In the alternative, the second annular skirt 58 may overlap and cover the first annular skirt 42.

In yet another embodiment, the second annular skirt 58 may be separate and independent piece and not be attached to the second flat panel 56. In this embodiment, the second annular skirt 58 fits over the vertical sides 22 and is attached to the previously installed cover portions 36 and 38. In the alternative, the first annular skirt 42 could be the independent piece.

Generally similar to those on the first cover portion 36, strips 48 and fasteners 50 are attached to the second cover portion 38. The strips 48 are generally attached to the second cover portion 38 and configured as described for the first cover portion 36 above. The strips 48 are also fitted with fasteners 50 on their second ends which extend from the second flat panel 56 and as generally described for the first cover portion 36 above. However, the length of the strips 48 and fasteners 50 may vary from the lengths of those attached to the first cover portion 36.

The strips 48 are configured to securely attach the top and bottom cover portions 36 and 38 to the spring core assembly 14 while minimizing the size of the hard fasteners 50. The strips 48 provide a member which can take up slack when the spring core assembly 14 is compressed. The strips 48 may extend approximately half way down the sides 22 of the spring core assembly 14 but alternatively, may extend more or less depending on the length of the fasteners 50 or the type of spring core assembly 14. Strips 48 may also be of slightly different lengths depending upon where they are placed around the perimeter of the flat top and bottom cover portions 36 and 38 to provide a more secure fit. Strips 48 may also be a different length depending on whether they are fitted to the top or bottom cover portions 36 and 38 to provide easier installation.

Figure 5:
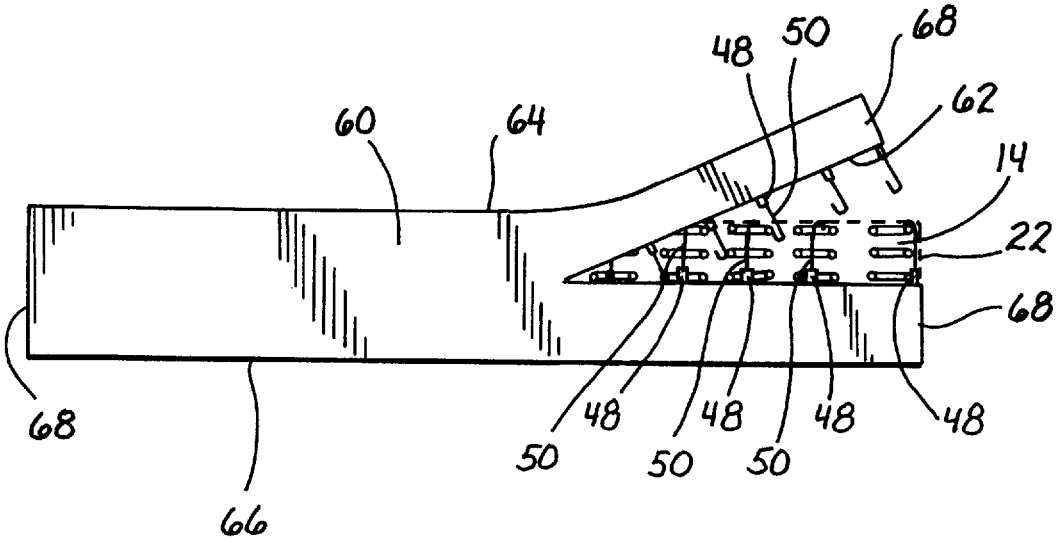
FIG. 5 is a side view of an alternative embodiment of the present invention installed over a conventional mattress spring core assembly and partially broken away to expose the spring core assembly.

An embodiment of the present invention, as shown in FIG. 5, includes a single piece cover 60 having a slit 62, or opening, for insertion of the spring core assembly 14. In this embodiment, the single piece cover 60 has a first panel 64 and a generally opposing second panel 66. The first and second panels 64 and 66 are connected together with annular skirt 68. The slit 62 generally extends around the annular skirt 68 parallel to the flat surfaces of the first and second panels 64 and 66.

The cover 60 may be fitted with strips 48 and fasteners 50 around, and generally adjacent to, the slit 62. The slit 62 is fitted with other fasteners (not shown) for closure such that the spring core assembly 14 is generally enclosed. Such fasteners may include a zipper, buttons, Velcro, snaps, and the like. As an alternative to the described fasteners, a series of holes and laces may be used to close the slit and synch down the cover 60. In another aspect, single cover piece 60 includes a slit 62 but is not fitted with any fasteners 50. The cover 60 may also not be fitted with any strips 48.

The slit 62 is generally only large enough to allow the spring core assembly 14 to fit inside. In this aspect, the generally tight fitting cover 60 is sufficient to prevent movement on the spring core assembly 14. The slit 62 is closed as described above. However, the slit 62 may be any size such that the spring core assembly 14 is retained partially by the fasteners 50 and partially by fit of the cover 60. The slit 62 may extend along one side 22 or may be sufficiently large such that the cover 60 may be folded open. The slit 62 may thus extend around three sides 22.

Figure 6:
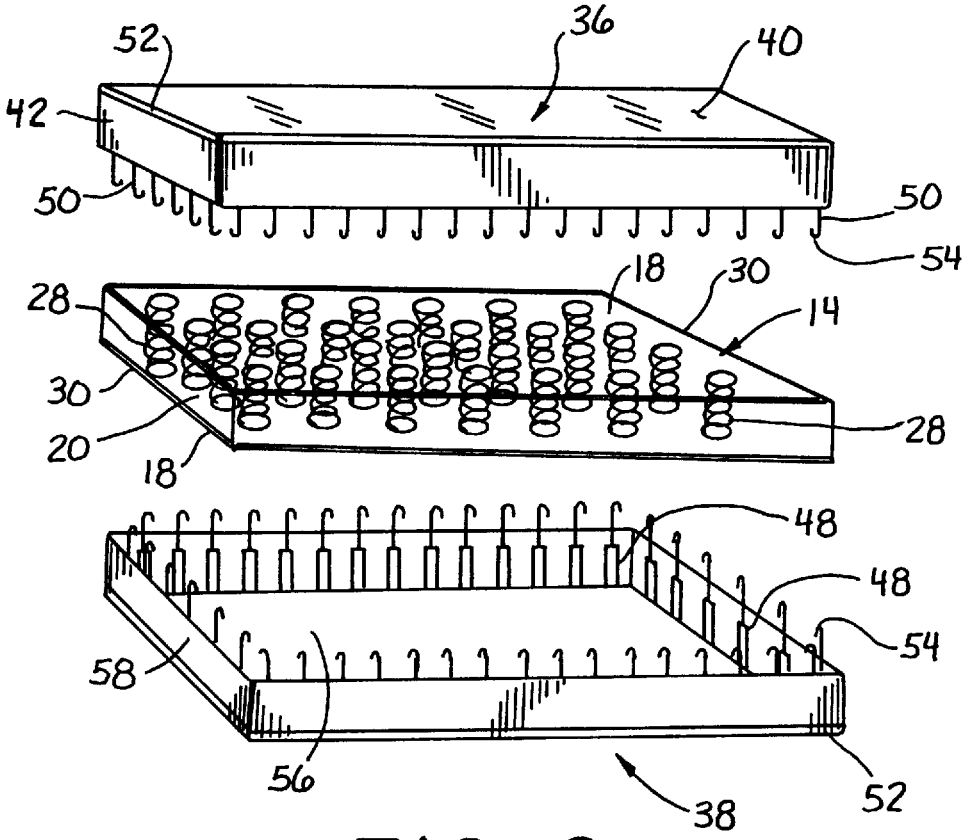
FIG. 6 is an exploded perspective view of a cover in accordance with the present invention installed on a mattress spring core assembly.

Now referring to FIG. 6, a method of placing a cover over a spring core assembly according to the principles of the present invention will be described. Generally, the original or previously fitted mattress cover 12 is removed form the spring core assembly 14 and discarded. It should be noted that this step is not required since the present invention may be fitted over a previous mattress cover 12 with little additional effort. However, for ease of installation, comfort, as well as sanitary reasons, it is suggested the previous cover be removed and discarded.

A first cover portion 36 having an attached annular skirt 42 is fitted on the top portion 18 of a spring core assembly 14. The attached annular skirt 42 is wrapped around the sides 22. The first cover portion 36 is then attached to the spring core assembly 14 by attaching fasteners 50 to the spring core assembly 14. In one embodiment, the fasteners 50 have hook shaped distal ends 54 which are attached over the border wires 30 of the spring core assembly 14. Alternatively, the hook shaped distal ends 54 may be placed over peripheral coils 28. The fasteners 50 may also be fitted with flexible ends such that they may be bent around peripheral portions of the spring core assembly 14. Prior to actual attachment of the fasteners 50 to the spring core assembly 14, the first cover portion 36 is pulled tight over the spring core assembly 14 and the spring core assembly 14 is compressed.

A second cover portion 38 generally having an attached second annular skirt 58 is fitted on the generally opposing bottom portion 18 of the spring core assembly 14. The second annular skirt 58 is fitted around the sides 22. The second cover portion 38 is then attached to the spring core assembly 14 in a generally similar manner as the first cover portion 36, and as described above. Engagement of the fasteners 50 to the spring core assembly 14 may require fitting the fasteners 50 under the first annular skirt 42 and rotating the distal ends 54 such that they engage the desired portion of the spring core assembly 14. Similar to attaching the first cover portion, the second cover portion 38 is pulled tight over the bottom portion 18 and the spring core assembly 14 is compressed prior to actual attachment of the fasteners 50 to the spring core assembly 14. The annular skirts 42 and 58 are then connected together.

While this invention has been described with respect of various specific examples and embodiments, it is to be understood that the invention is not limited thereto and that it can be variously practiced within the scope of the following claims.

What is claimed is:

1. A cover for a mattress spring core assembly having a spring core top, a spring core bottom and a plurality of spring core sides, said cover comprising:

a first panel having a plurality of peripheral edges, said first panel for placement on the spring core top;

a plurality of first flexible strips attached in a spaced apart fashion to each of the peripheral edges of said first panel, said first strips extending away from said first panel such that at least two of said first strips extend along each of said spring core sides;

a generally opposing second panel having a plurality of second peripheral edges, said second panel for placement on the spring core bottom;

a plurality of second flexible strips attached in a spaced apart fashion to each of the peripheral edges of said second panel, said second strips extending away from said second panel such that at least two of said second strips extend along each of said spring core sides;

a plurality of fasteners, each of which has a proximal end attached to one of said first and second strips, and a distal end for connection with said spring core such that said fasteners attach said first and second panels irrespectively, to the spring core;

an annular skirt connecting said first and second panels, said annular skirt extending around the first and second panels such that said spring core may be placed between said first and second panels; and a slit along at least a portion of the annular skirt and extending generally parallel to said first and second panels.

2. The cover of claim 1 wherein said slit extends from approximately 20 to 80 percent around said annular skirt such that said first and second panels may be folded at least partially open.

3. The cover of claim 2 wherein the distal end of each fastener comprises a hook.

4. A cover for a mattress spring core assembly having a top, a plurality of sides and an opposing bottom, said cover comprising:

a first cover portion having a first panel for covering said top and an attached first annular skirt extending around a peripheral edge of said first panel;

a second cover portion generally opposing said first cover portion, said second cover portion having a second panel and an attached second annular skirt extending around a peripheral edge of said second panel;

a plurality of first flexible strips, each of which has a first end attached to said first cover portion and a second end which extends away from said first panel, said plurality of first strips disposed in a spaced apart fashion around said peripheral edge of said first panel such that a plurality of said first strips extend along each of said sides of said spring core;

a plurality of second flexible strips, each of which has a first end attached to said second cover portion and a second end which extends away from said second panel, said plurality of second strips disposed in a spaced apart fashion around said peripheral edge of said second panel such that a plurality of second strips extend along each of said sides of said spring core;

a plurality of fasteners, each having a proximal end attached to said second end of one of said first and second strips and a distal end for connection with the spring core assembly; and wherein said fasteners attach said first and second panels, irrespectively, to the opposing top and bottom of the spring core assembly such that the first and second cover portions generally enclose the spring core assembly.

5. The cover of claim 4 wherein the distal end of each fastener comprises a hook.

6. The cover of claim 5 wherein at least some of the hooks are bendable such that each distal end can be bent around a desired portion of the spring core assembly.

7. The cover of claim 4 wherein at least one of the first and second cover portions comprises a padded surface.

8. The cover of claim 4 wherein the first and second annular skirts generally extend an equal distance away from the respective first and second panels such that the first and second annular skirts meet in an abutting fashion along the plurality of sides of the spring core assembly.

9. The cover of claim 8 wherein the first and second annular skirts are configured with at least one zipper for connection to each other.

10. The cover of claim 4 wherein at least one of said first and second annular skirts extends down the sides of said spring core assembly and overlaps at least a portion of the other of said first and second annular skirt.

11. The cover of claim 10, and further comprising hook and loop material such that said first and second annular skirts may be removably connected together.

12. The cover of claim 4 wherein the first panel is slightly larger than the second panel such that the first annular skirt encircles and overlaps the plurality of fasteners attached to the plurality of second strips.

13. The cover of claim 4, and further comprising and additional annular skirt for fitting around and covering at least a portion of the sides of said spring core such that at least a portion of the first and second annular skirts are overlapped and covered.

14. A method for placing a cover on a mattress spring core assembly having a spring core top an opposing spring core bottom, and a plurality of spring core sides, said method comprising the steps:

placing a first cover portion having a first panel with an attached annular skirt and a plurality of spaced apart first strips, each of the first strips extending away from the first panel and coupled to a fastener, on the spring core top such that the annular skirt is wrapped around and covering at least a portion of each of the spring core sides and ends and at least two of the plurality of first strips and attached fasteners extend from each of said sides and ends;

attaching the first cover portion to the spring core using the plurality of fasteners connected to the first cover portion;

placing a second cover portion having a second panel with an attached second annular skirt and a plurality of spaced apart second strips, each of the second strips extending away from the first panel and coupled to a fastener, on the spring core bottom such that the second annular skirt is wrapped around and covering at least a portion of each of the spring core sides and at least two of the plurality of second strips and attached fasteners extend from each of said sides; and attaching the second cover portion to the spring core using the plurality of fasteners connected to the second cover portion.

15. The method for placing a cover according to claim 14, and further comprising the step of first removing the existing mattress spring core assembly cover such that only the spring core assembly remains.

16. The method for placing a cover according to claim 14, and further comprising the step of rotating the spring core assembly such that the spring core bottom is on top and is facing upwardly.

17. The method for placing a cover according to claim 14, and further comprising the step of connecting the first annular skirt to the second annular skirt such that the spring core assembly is substantially enclosed by the first and second cover portions.

18. The method for placing a cover according to claim 14 wherein the step of attaching the first cover portion to the spring core assembly further comprises the steps:

compressing at least a portion of the spring core assembly;

extending a fastener in connection with the first cover portion vertically downwards along the sides of the spring core and towards the spring core bottom to an attachment location on the spring core assembly such that the first cover portion is pulled taut over the spring core top;

attaching the fastener to the spring core assembly at the attachment location, repeating the extending and attaching steps until each of the fasteners connected to the first cover portion is attached to the spring core assembly; and relieving the compressed spring core assembly.

19. The method for placing a cover according to claim 18 wherein the step of attaching the second cover portion to the spring core assembly comprises the steps:

rotating the spring core assembly such that the spring core top with the first cover portion attached is on bottom and the exposed portion of the spring core assembly is on top and facing upwardly;

compressing at least a portion of the spring core assembly;

extending a fastener in connection with the second cover portion away from the second cover portion and towards the spring core top to a second attachment location on the spring core assembly such that the second cover portion is pulled taut over the upwardly facing spring core top, said second attachment location being under the first annular skirt which extends over said attachment location;

attaching the fastener to the spring core assembly at the second attachment location;

repeating the extending and attaching steps until each of the fasteners connected to the second cover portion is attached to the spring core assembly; and relieving the compressed spring core assembly.

20. The cover of claim 4 wherein at least one of said plurality of first strips and said plurality of second strips comprises an elastic material.

* * * * *

UNITED STATES PATENT AND TRADEMARK OFFICE

CERTIFICATE OF CORRECTION

PATENT NO. : 5,768,726

DATED : June 23, 1998

INVENTOR(S) : Myles

It is certified that error appears in the above-identified patent and that said Letters Patent is hereby corrected as shown below:

Column 8, line 23; delete "irrespectively" and insert in place thereof --respectively--.

Column 8, line 13; delete "and", second occurrence, and insert in place there of --an--.

Column 8, lines 59-60; delete "top an opposing spring core bottom and" and insert in place thereof --top, an opposing spring core bottom and--.

Column 10, line 6; delete the comma after "location" and insert in place thereof a semi-colon.

Signed and Sealed this

Tenth Day of April, 2001

*Attest:*

Nicholas P. Godici

NICHOLAS P. GODICI

*Attesting Officer*

*Acting Director of the United States Patent and Trademark Office*